US005775319A

United States Patent [19]

Pettinari

[11] Patent Number: 5,775,319

[45] Date of Patent: Jul. 7, 1998

[54] COOKER HOOD COMPRISING A SUCTION AND/OR FILTRATION UNIT

[75] Inventor: Pierluigi Pettinari, Cerreto d'Esi, Italy

[73] Assignee: Turboair S.p.a., Fabriano, Italy

[21] Appl. No.: 584,010

[22] Filed: Jan. 11, 1996

[51] Int. Cl.[6] ..... F24C 15/20

[52] U.S. Cl. ..... 126/299 R; 126/299 D

[58] Field of Search ..... 126/299 R, 299 D, 126/301

[56] References Cited

U.S. PATENT DOCUMENTS

| | | | |
|---|---|---|---|
| 2,836,114 | 5/1958 | Weaver et al. | 126/299 D |
| 4,133,300 | 1/1979 | Burton et al. | 126/299 D |
| 4,500,331 | 2/1985 | Cheng | 126/299 D |

FOREIGN PATENT DOCUMENTS

| | | | |
|---|---|---|---|
| 7625674 | 6/1976 | Australia . | |
| 2409288 | 9/1974 | Germany | 126/299 D |
| 3529951 | 3/1987 | Germany . | |
| 101438 | 6/1985 | Japan . | |

*Primary Examiner*—Carroll B. Dority
*Attorney, Agent, or Firm*—Levine & Mandelbaum

[57] ABSTRACT

A hood comprising a suction and/or filtration unit, to collect cooking fumes of a houshold cooker, complete and functionally independent from the hood housing, provided with means for simple and fast insertion and pull-out from the housing without the use of tools in a fully safe manner for the user.

Said suction and/or filtration unit is provided with electric contacts firmly fastened to its structure, which upon insertion in the housing will be connected to a power take-off rigidly fastened inside the housing, so that the electric parts of the unit are live only when the unit is inserted in the housing.

12 Claims, 7 Drawing Sheets

COOKER HOOD COMPRISING A SUCTION AND/OR FILTRATION UNIT

FIELD OF THE INVENTION

The present invention relates to a hood comprising a suction and/or filtration unit to collect the cooking fumes of a household cooker.

DESCRIPTION OF THE BACKGROUND ART

Various types of household hoods to eliminate the cooking smells in the kitchen are known; in such hoods the air to undergo a purification treatment or be ejected outside typically flows through the following means: a grease filter to remove solid floating soil, an activated-carbon filter (only in case the air will be recycled to the kitchen), a centrifugal fan with scroll and, finally, a duct called conveyor, eventually fitted with deflection valves to convey the air to one or more outlets according to the different kinds of operation.

In most cases, the centrifugal fan, scroll and conveyor form just one subassembly, briefly denominated suction unit, which is attached as a preassembled unit inside the hood housing, usually made of steel-sheet, whereas at times the control panel containing the hood controls forms one body alone with the suction unit and protudes outside the housing through a proper opening. Other times, on the contrary, the control panel is attached separately to the housing and connected to the unit by electric cables alone.

The activated-carbon filter, that can be easily removed for replacement purposes, is fastened to the suction unit in various ways. The grease filter, which is always fastened to the housing, is used to close the hood on its lower side and can be removed by the user without the use of tools.

Normally, the scroll and conveyor upper walls consist of the housing upper surface where the unit is fastened to. The unit electric components are then connected to the power cord by a terminal. Obviously, all electric functional parts are protected against a likely casual contact by the user and can be accessed only by removing the protecting covers with the use of tools; also the electric cables, duly insulated, are generally not accessible to the user or they are firmly fastened to withstand specific tear-off tests as required by the safety standards.

The unit is fastened to the housing by self-tapping screws inserted from the outside of the housing; about ten screws should be used to avoid any unwanted air leaks from the ducts to the housing upper surface.

Most hoods and anyway low-cost hood types to be installed in a kitchen are supported over the cooking top by fastening them under the bottom of a wall hanging cabinet with the use of self-tapping screws.

However, there are also low quality hoods called chimneys available on the market, with a high aesthetic function for the kitchen furnishing. Usually, said chimneys are dimensionally higher than low-cost hoods, are provided with an air outlet upwards to expell and recycle the air and their outside housing may have different forms. In general, said chimneys are not provided with the same suction unit as for the hoods located under a wall hanging cabinet, also due to the fact that they do not usually have a flat surface for the unit to adhere to and complete the air ducts outside walls.

The method previously described of assembling the suction unit to the housing and the hood to the wall hanging cabinet shows several drawbacks.

Once the hood has been assembled under a wall hanging cabinet, the heads of the screws locking the unit to the housing are no longer accessible from the cabinet bottom. Therefore, in order to remove the suction unit from the housing, the hood must be separated again from the housing, i.e. an operation usually carried out in case of repair where the unit needs to be removed. As a result, many constraints are set for the design of a suction unit to obtain that most repairs may be made from underneath, however from a still uncomfortable position.

Therefore, most or all electric components are accessible from underneath.

However, since for normal maintenance operations the hood can be accessed inside also by the user after removing the grease filter and the carbon filter, it is imperative in conformity to the safety standards that said electric parts be protected by covers only removable with the use of tools and that the electric cables be firmly fastened or also have a cover protection.

Moreover, even if a hood is a receptacle of dirt and bacteria it is unthinkable to suggest removing the suction unit to clean the air ducts; also the surfaces inside that can be accessed by removing the grease filter are difficult to reach also with the risk of getting injured over the screw tips that protude from the housing top.

Finally, it is quite unthinkable that some hood parts may be recovered and the scrapper may care to separate a suction unit usually made of plastic material from a housing usually made of steel-sheet and remove all the screws that keep them fastened together. Also a separation of the cables firmly fastened to withstand tear-off tests and of the well protected electric components appears somewhat doubtful.

OBJECTS OF THE INVENTION

Accordingly, it is the object of the present invention to solve the above problems, in particular to allow an unexperienced user to assemble and disassemble a hood suction unit in and from its housing, in a fully safe manner, without having to reach the housing outside top and without the use of any screws and/or other fastening elements requiring the use of tools, neither for the fastening of said suction unit to the housing nor for connecting the unit to the power cord.

It is also the object of the present invention to provide access for cleaning purposes inside the scroll, without removing the preassembled electric motor-fan unit and the suction unit, in a fully safe manner for the user.

It is a further object of the present invention to provide a suction unit, which though of compact design as required for insertion inside a hood to be assembled under a wall hanging cabinet, may also be assembled not close-by a housing for a much wider applicability, at least for the many types of hoods and chimneys at various aesthetic and quality levels, where air discharge is provided exclusively from the top.

These and other objects are provided by the present invention with a hood comprising a suction and/or filtration unit to collect the cooking fumes of a household cooker, which incorporates the characteristics of the annexed claims.

BRIEF DESCRIPTION OF THE DRAWINGS

The characteristics and advantages according to the present invention will be more evident from an illustration of the suction hoods according to the present state of the art and from the description of the hood according to the present invention in some main embodiments as shown in the following figures, which are supplied only as an explanatory and not limiting example, omitting for better understanding the parts that do not apply to the invention, wherein.

Figure 3:
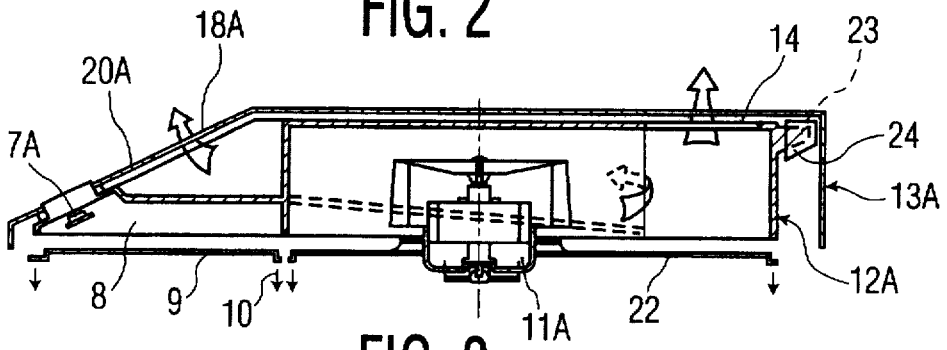
FIG. 3 shows schematically a side section of the hood containing the suction unit according to one of the main embodiments of the present invention.
Figure 4:
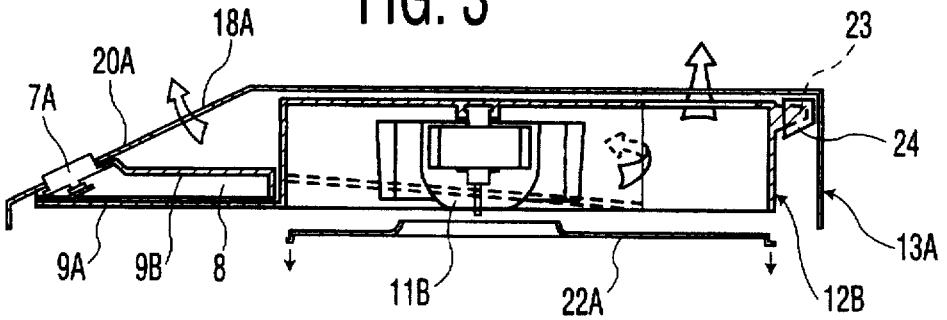
FIG. 4 shows schematically a side section of the hood containing the suction unit according to another main embodiment of the present invention.
Figure 5:
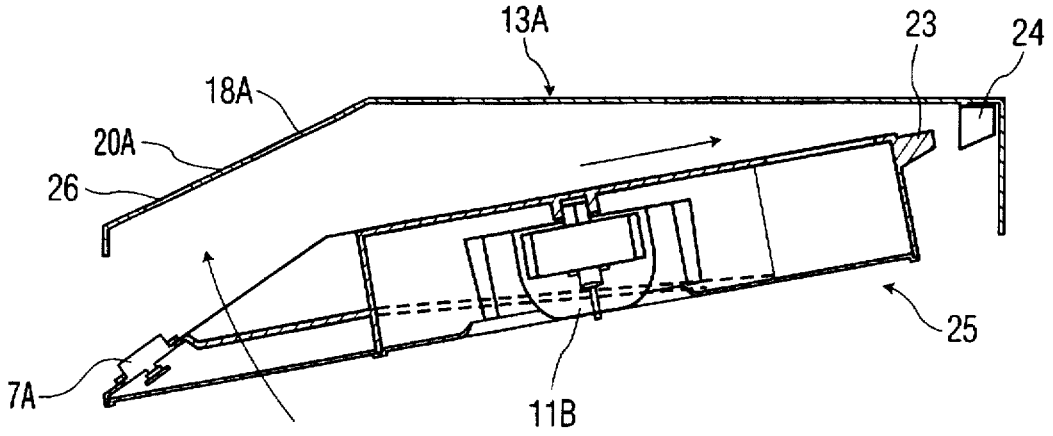
FIG. 5 shows schematically a side section of the suction unit shown in FIG. 3 or FIG. 4 and the motion required to assemble it inside the hood housing.
Figure 6:
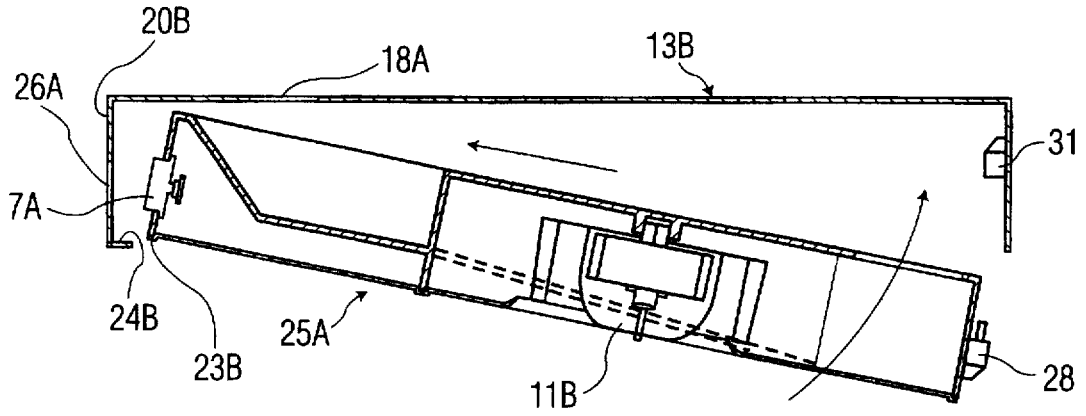
FIG. 6 shows schematically a side section of another possible embodiment of the suction unit according to the sent invention being inserted inside hood housing.
Figure 7A:
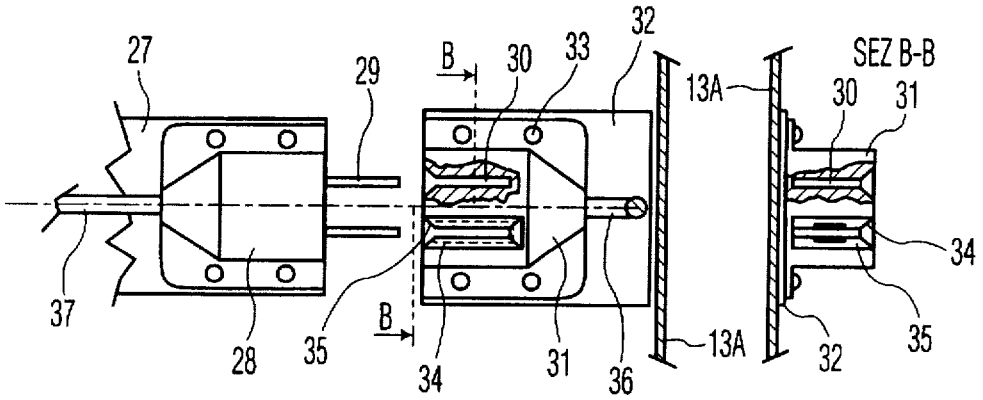
FIG. 7—split in three detailed sections A, B and C—shows schematically two elements forming an electric connection means from the suction unit and the hood power cord according to the present invention, namely.
Figure 7B:
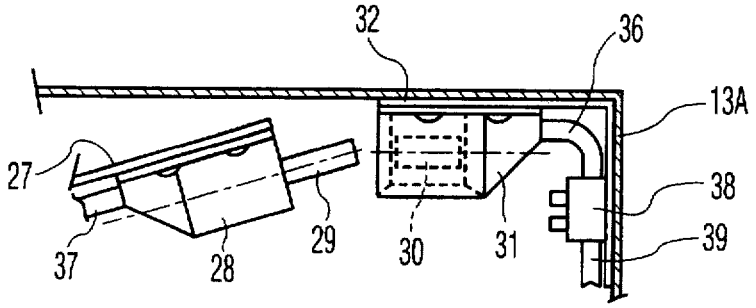
Figure 7C:
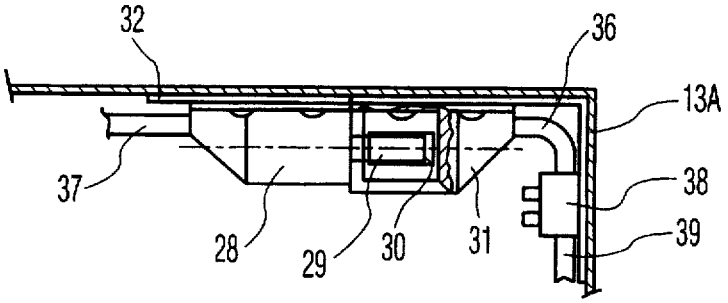
Figure 8A:
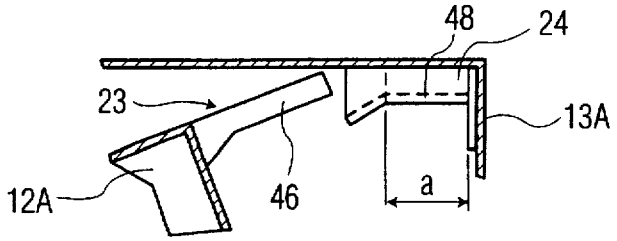
Figure 8B:
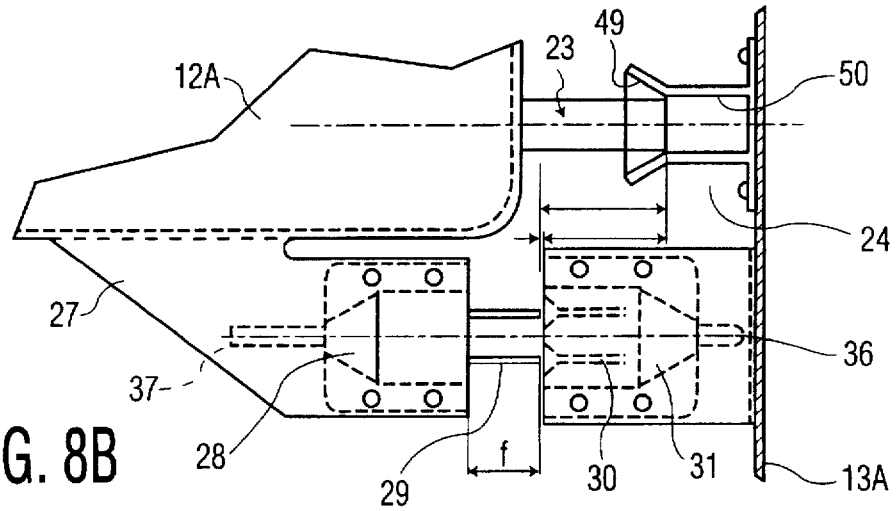
Figure 8C:
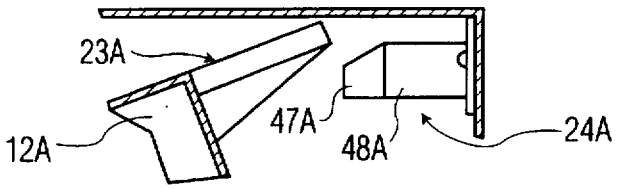
Figure 8D:
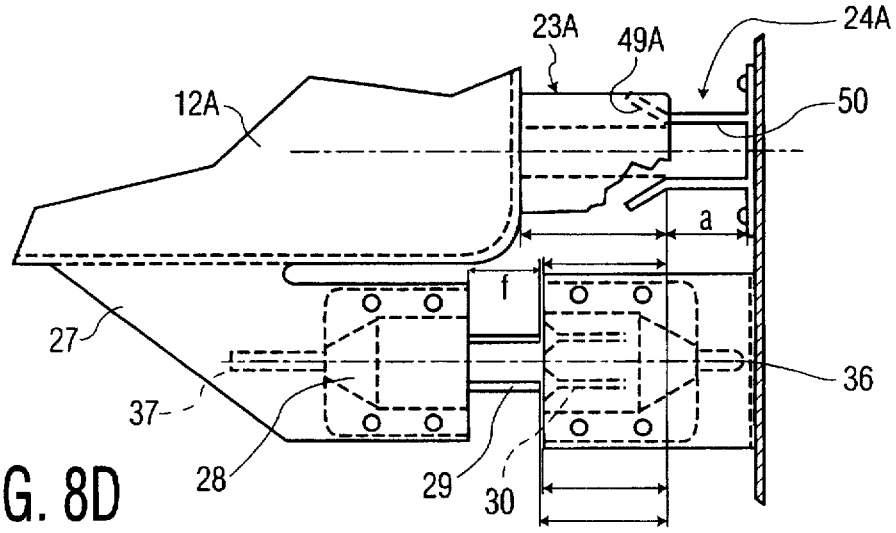
Figure 9:
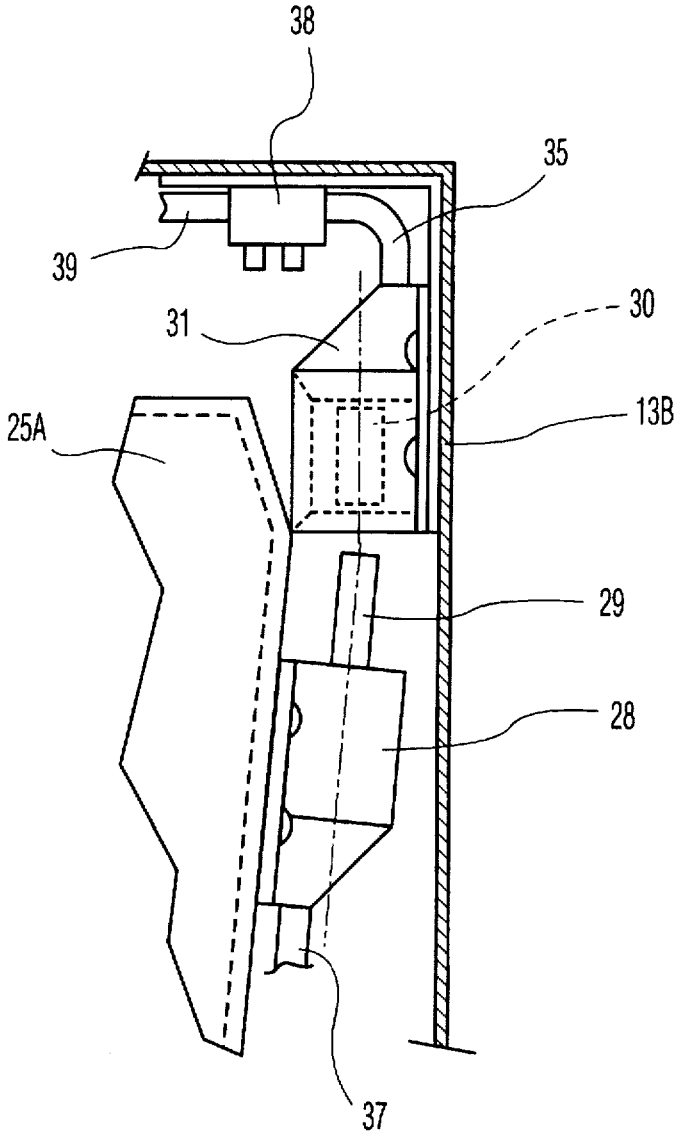
Figure 10A:
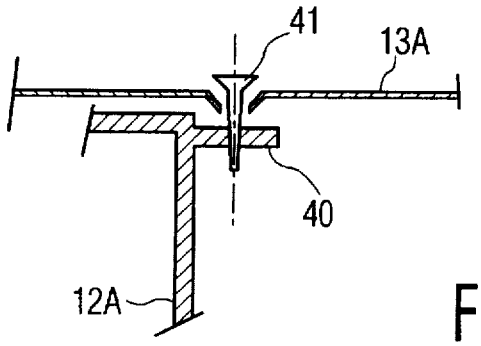
Figure 10B:
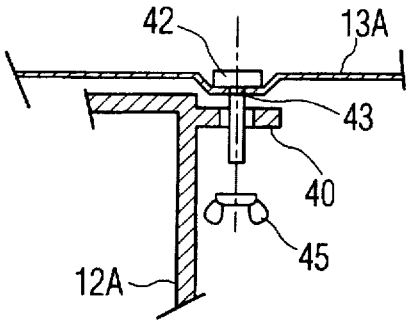
Figure 10C:
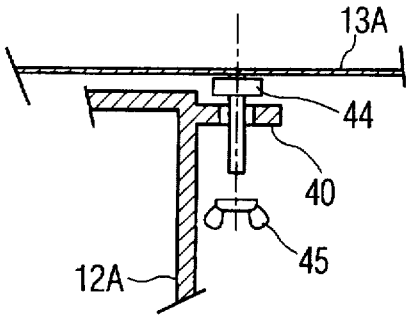
Figure 10D:
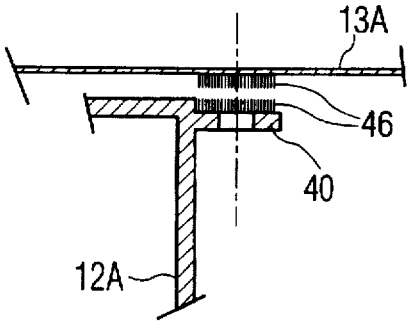
Figure 11:
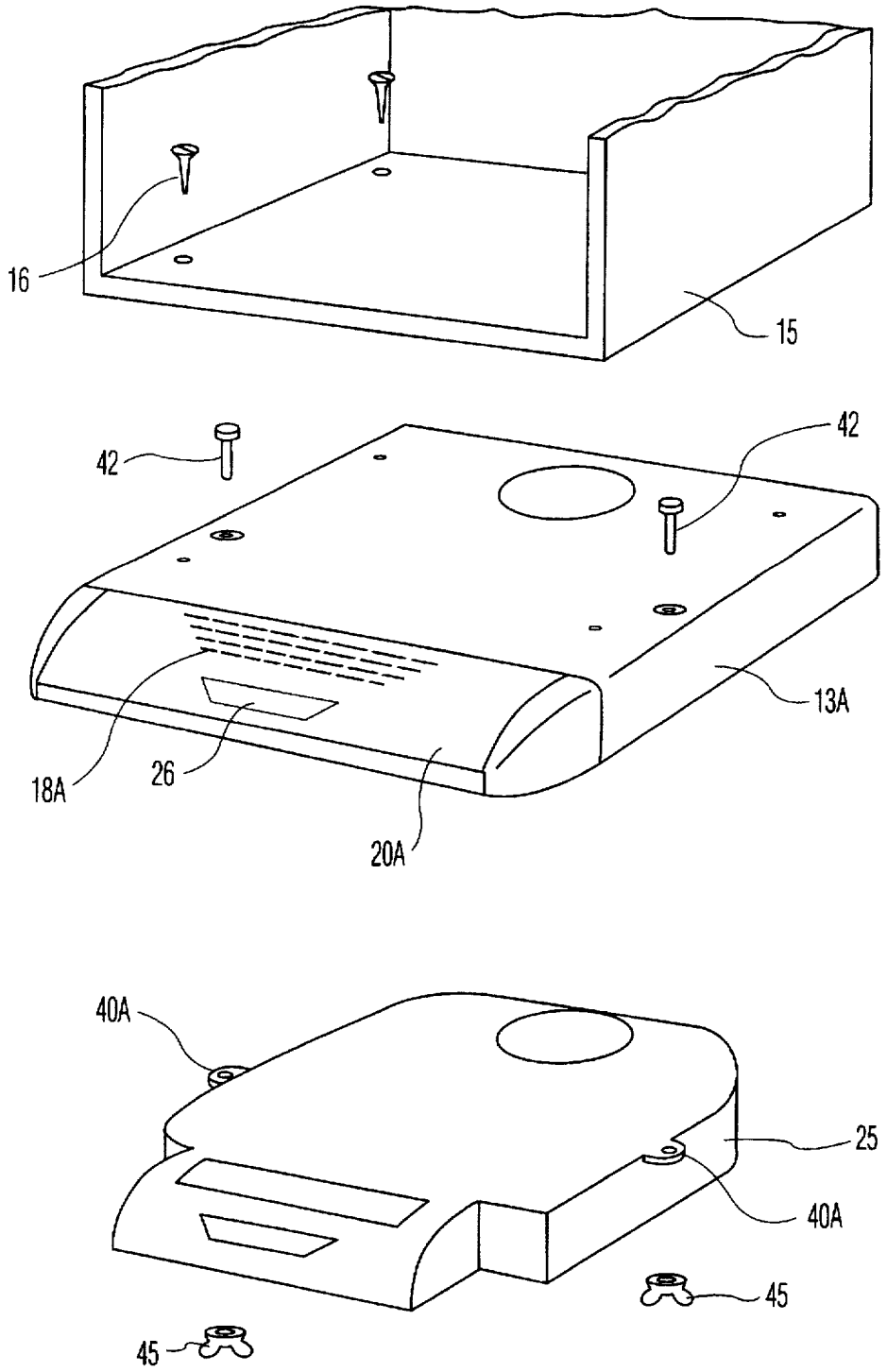

section A shows a view of both elements from underneath before they are inserted in each other as well as a view and partial section according to the line B—B of one of said two elements;

section B shows a side view of said elements still separated from each other;

section C shows a side view of said elements inserted in each other;

FIGS. 8A and 8B shows a detailed view of the hood rear side according to FIG. 5 (both side and top views), the elements of the electric connection means shown in FIG. 7, fastened to the suction unit and hood housing, and also one of the many possible centering means to guide the suction unit to its position inside the hood housing;

FIGS. 8C and 8D differs from FIGS. 8A and 8B respectively show for one of the many possible changes to the centering means to guide the suction unit to its position inside the hood housing;

FIG. 9 shows laterally as a detailed view of the hood rear side according to FIG. 6, the elements of the electric connection means of FIG. 7 fastened to the suction unit and hood housing;

FIG. 10A shows in section the fastening method of the suction unit to the hood housing according to the present state of the art; FIGS. 10B thru 10D show some examples of fastening means for the anchoring of the suction unit inside the hood according to the present invention;

FIG. 11 shows axonometrically the hood and the suction unit according to one of the embodiments of FIGS. 3 or 4.

DETAILED DESCRIPTION OF THE INVENTION

Figure 1:
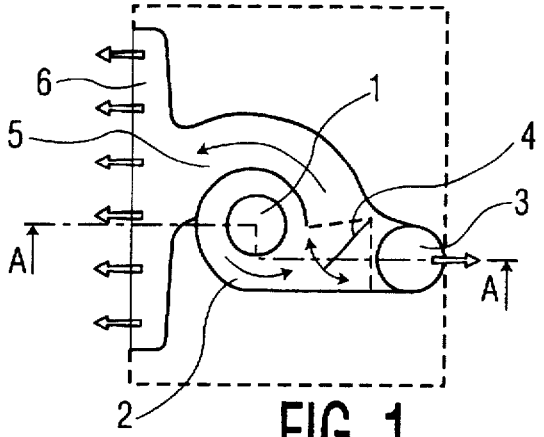
FIG. 1 shows schematically a plan of a general hood suction unit according to the most used embodiment.

FIG. 1 shows very schematically a top view of a motor-fan assembly 1, a scroll 2, an air upper outlet 3, a front/rear deflecting valve 4, a conveyor 5 to the front and a front outlet 6; a section line A—A is also drawn.

Figure 2:
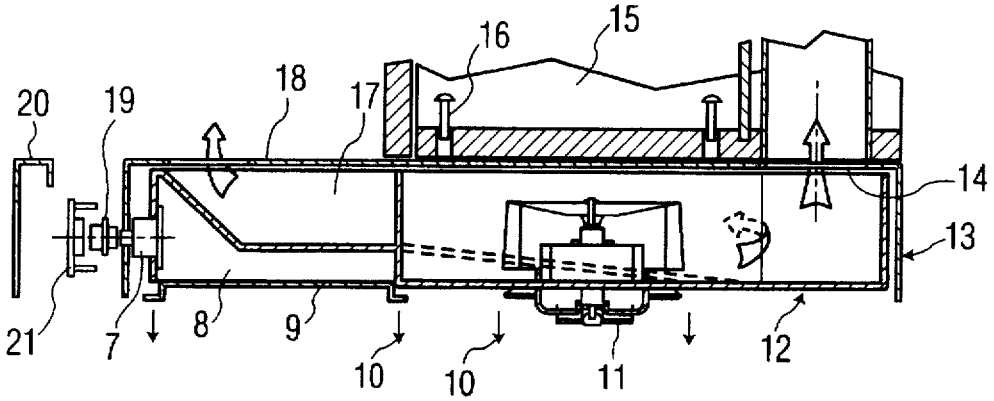
FIG. 2 shows schematically a side section of a hood containing the suction unit shown in FIG. 1 and of the relevant housing according to section line A—A; the walls delimiting the air ducts and enclosing the electric pants according to the present state of the art are also shown.

In FIG. 2 reference number 7 indicates the electric componentry to be connected with the hood outside controls, number 8 indicates a recess where the electric componentry 7 and other likely electric components are located; number 9 indicates a protection cover for recess 8, number 10 indicates some fastening screws, number 11 indicates a nosepiece-motor-fan subassembly, number 12 indicates a suction unit main body according to the present state of the art; number 13 indicates a hood housing, number 14 indicates an air upper outlet, number 15 indicates a part of a overhanged wall cabinet, number 16 indicates some self-tapping screws to fasten the cabinet-housing; number 17 indicates an air conveying duct to the front, number 18 indicates a front air outlet, number 19 indicates some press-button or slider controls, number 20 indicates an aesthetically finished front panel, number 21 indicates a grill holding the controls 19. For better graphic understanding of said FIG. 2 the valve 1 of FIG. 1 is omitted where the arrows show the admitted air paths.

In FIG. 3, where the hood according to the present invention is shown, reference number 7A indicates an electric componentry functionally and aesthetically inclusive of the controls accessible for the user (i.e. already inclusive of elements 19 and 21 of FIG. 2), number 8 indicates a recess where said componentry 7A and other likely electric components are located, number 9A indicates a protection cover for recess 8, number 10 indicates the fastening screws, number 11A indicates a preassembled motor-fan unit 11A, number 12A indicates a suction unit main body of a main embodiment of the present invention, number 13A indicates a hood housing according to the same embodiment of the invention, number 14 indicates an air upper outlet, number 17 indicates an air conveying duct to the front and number 18A indicates a front opening for air outlet; number 20A indicates a hood front panel, number 22 indicates a scroll cover on which a preassembled motor-fan 11A unit is located, number 23 indicates a first element of a centering means integral with the main body 12A and number 24 indicates a second element of a centering means integral with the housing 13A. Also in FIG. 3 like the previous FIG. 2 and subsequent similar FIGS. 4, 5 and 6, the valve 4 of FIG. 1 is omitted, where the arrows show the air paths for better graphic understanding. Moreover, both the body 12A and housing 13A are provided with electric connecting means (28,31), not shown, which will be further described with reference to FIGS. 7 and 8.

FIG. 4 differs from FIG. 3 for its cover 9B, for its preassembled motor-hub-fan unit 11B, for its cover 22A and for its suction unit main body 12B provided with a fixed bottom 9A. The remaining reference numbers show the same elements as in FIG. 3. Unit 11 B is fastened to the main body 12B through usual means.

FIG. 5 shows a suction unit 25 filly preassembled, consisting freely of the elements shown either in FIG. 3 or 4. Moreover, FIG. 5 shows the element 23 of the above mentioned centering means, which are integral with the main body of suction unit 25A and the second element 24 of the same centering means, which is integral with the housing 13A. Also a hood front panel 20A is shown, where a front opening 18A for air outlet and a recess 26 to locate the electric componentry 7A complete with controls are obtained. The arrows show the rotary and traverse motion required for correct insertion of the suction unit in the housing.

FIG. 6 shows a suction unit 25A fully assembled, designed according to a further embodiment of the present invention, featuring a centering and support edge 23B, the electric componentry 7A complete with controls and a first element 28 of an electric connection means. This figure also shows a housing 13B with opening 18A for air outlet on the front, a recess 26A to house the electric componentry 7A complete with controls, a support or centering area 24B and a second element 31B of an electric connection means. The arrows indicate the rotary and traverse motion required for correct insertion of the suction unit in the hood housing.

As previously mentioned, FIG. 7A, 7B and 7C consist of three detailed sections.

Section A shows a support 27 integral with the suction unit according to any embodiment of the present invention, where 28 indicates the body of a first element of an electric connection means from the suction unit to a power cord; 29 indicates the pins of element 28, 31 indicates the body of a second element of said electric connection means from the suction unit to a power cord; 30 indicates some flat electric contacts of the body 31, 32 indicates a support integral with the hood housing 13A according to any embodiments of the present invention; 33 indicates some fastening means of said body 31 to the support 32, 34 indicates some openings provided with lead-in flares 34, 35; 36 and 37 indicate some electric connection cables to the outside power supply cord and to the suction unit electric parts, respectively.

Section B, where the same elements of section A are shown, number 38 indicates a terminal board 38, which connects the electric cable 36 with the power cord 39.

Section C shows the same elements of sections A and B, however differing in that the bodies 28 and 31 of the electric connection means are close to each other and the pins 29 are inserted in the electric contacts 30, the same as for the suction unit assembled inside the hood.

FIGS. 8A and 8B respectively show both a side plan view of the element 23 of the centering means integral with the main body 12A (or 12B) of any suction unit according to the embodiments of the present invention shown in FIGS. 3 or 4, where number 24 indicates the second element of the centering means fastened in a usual manner as known to the housing 13A according to the same embodiments of the invention. The plan view also shows the body 28 of the first element of the electric connection means, which is integrally fastened to the rear side of said main body 12A through the support 27 and the body 31 of the second element of the electric connection means fastened to said housing 13A in a known manner. The more external part 46 of the element 23 forms substantially a parallelepipedon; the hollow shaped element 24 has its outside part formed by flared walls 47 and 49, wheras its more internal part forms a parallelepipedon with the length "a" consisting of the walls 48 and 50. The figure also shows pins 29 with length "f"<"a", the electric contacts 30, the cable 37 for connecting the inside electric componentry and the cable 36 for connection to the mains through a terminal and power cord not shown in the figure.

FIG. 8C and 8D respectively show some elements having the same functions as in the previous figure: the element 23A whose section is "T" shaped, whereas the element 24A is substantially formed by two guiding wings, whose outside part has a tapered upper profile 47A and a retracted plan profile 49A, whereas the more internal part with Length "a" delimits some parallelepiped shaped spaces with its profiles 48A and 50A. The remaining elements are substantially similar to the ones shown in FIG. 8A; in particular, pins 29 have length "f"<"a" also in this version.

FIG. 9 shows—according to the embodiment of FIG. 6—the body 28 of the first element of said electric connection means fastened to the rear side of the suction unit 25A and the body 31 of the second element of said electric connection means fastened to the hood housing 13B.

FIG. 10 shows four possible fastening means of a top area of a general hood housing 13A to a general flange 40 of a general main body 12A of a suction unit. Section A shows a self-tapping screw 41 as it is used in the present state of the art. Section 13 shows a bolt to be tightened by a wing nut 45 and with a throat 43. The bolt 42 is hindered from rotating in its seat by any known means not shown in the figure. Section C shows a projection-weld type bolt 44 and the above wing-nut 45. Section D shows schematically a pressure fastening method 46, which is called Velcro in trade.

FIG. 11 shows a suction unit 25 and a hood housing 13A similar to the ones shown in FIG. 5, where 15 indicates the bottom of a wall hanging cabinet, 16 the fastening screws, 42 the tightening bolts, 40A the pierced lugs and, finally, 45 the mentioned wing-nuts.

With regard to operation, FIG. 1 shows the possible air-flow paths in a hood according to the present state of the art or according to the present invention. Many hoods are also provided with an outlet to the wall behind the hood; said option, quite irrelevant for the description herein, has been omitted for a better understanding of the above illustrations.

According to the present state of the art shown in FIG. 2, both the assembly and setup of a hood is carried out as follows: insert the electric componentry 7 and other likely electric components previously wired to the preassembled nosepiece-motor-fan unit 11; fasten the cover 9 and preassembled unit 11, 22 with the screws 10; assemble the suction unit in the housing 13 and fasten it with screws 41 as shown in FIG. 10A; assemble the controls 19 and elements 20 and 21 outside; fasten the terminal not shown in the figure to the housing 13 to join the inside cables and the power cord and proceed with other finishing operations, such as assembly of the activated-carbon filter, grease filter, etc., which do not apply to the present description.

In the practical use, the hood is fastened underneath a wall hanging cabinet 15 with the use of self-tapping screws 16. After assembly, the screw heads 41 shown in FIG. 10A will be covered by the cabinet 15. It should be noted that due to a subsequent extremely troublesome dismantling of the hood from the wall hanging cabinet, both the access to the electric componentry contained in the recess 8 through cover 9 and screws 10 and assembly from underneath the preassembled nosepiece-motor-fan unit 11 are necessary according to the present state of the art.

With regard to the description of the present invention according to one of the main embodiments and with reference to FIG. 3, the suction unit is assembled by inserting in the recess 8 the electric componentry 7A complete with all controls and other likely electric components, fastening cover 9 and cover 22 (on which the motor-fan unit 11A has already been preassembled) to the main body 12A with screws 10. All electric parts have already been previously wired to each other; with reference to FIGS. 8A or 8B the connecting cables 27 reach the body 28 to be fastened to the support 27 integral with said main body 12A. Referring to FIG. 7, the body 31 and terminal 38 already inclusive of the connection cable 36 and power cord 39 are fastened to the housing 13A. If necessary, the terminal 38 can also be protected against casual contacts in a known manner, not shown in the figure.

Referring to FIG. 5, the complete suction unit 25 is inserted in the housing 13A with a rotary and traverse motion. Only after having been positioned said suction unit is electrically connected with the power cord. As a matter of fact, with reference to FIG. 8A, the element 23 engages the element 24 during insertion and guides the suction unit to the desired insert position. The body 28 and body 31 engage to each other shortly after a partial coupling of said element 23 with said element 24. Thus, a correct coupling of the electric connections is guided by the centering elements 23 and 24.

As it can be seen in FIG. 7, insertion of pins 29 among the flat contacts 30 is possible even if said pins are not yet in a horizontal position, as a relevant rotation of both elements 29 and 30 on the vertical plane is possible thanks to the slots in the body 31 whereas, with reference to FIG. 8A, the side walls 50 of the centering element 24 ensure a collect positioning in a transversal direction. Looking at FIG. 3 it is clear that having accomplished this positioning the electric componentry 7A complete with outside controls of FIG. 3 has reached its final position and can be accessed from outside of the housing 13A. Fastening of the suction unit 25 shown in FIG. 5 will then be completed by locking it to the housing 13A with any of the means mentioned in the detailed sections of FIG. 10 or any other known equivalent means, provided they can be accessed from inside said housing.

FIG. 11 shows how the suction unit 25 can be fastened to the hood housing 13A using two tightening bolts 42 alone. As a matter of fact, said bolts should not ensure any support of the air ducts according to the known state of the art, but only have a function of front support, whereas on the rear side said unit is supported by the centering means shown in FIG. 8A or equivalent ones. Obviously, also the same considerations for the embodiment of the present invention shown in FIG. 6 apply. Hood assembly underneath a wall hanging cabinet 15 is done according to the present state of the art and as shown in FIG. 11.

With reference to FIG. 5, to remove the complete unit 25 from the housing 13A once the hood has been installed underneath a wall hanging cabinet, it will be enough to operate without the help of tools the fastening means shown in FIG. 10 already mentioned.

FIG. 8B shows another centering means optional to the one of FIG. 8A, where the walls 49A and 50A have the same guiding functions of the relevant walls 49 and 50 in FIG. 8A, the same as the profiles 47A and 48A have the same functions of walls 47 and 48. It is obvious that many changes are possible to the manufacturing of said centering means, as well as many dimensional changes are also possible to the elements shown in the FIGS. 7, 8A and B, provided it is warranted—with reference to FIG. 8A—that the element 23 engages the element 24 before the pins 29 engage the element 31 and that said pins 29 are not hindered from complete insertion in said element 31 due to unwanted interferences.

FIG. 4 shows some important changes to the embodiment of the present invention illustrated above. Since according to the invention herein the suction unit can now be easily removed, it is no longer necessary for the electric componentry contained in the recess 8 to be accessed from the bottom and be protected against casual contacts with covers or other means removable with the use of tools.

Therefore, it is possible to use the cover 9B, which can be reached only after disassembly of the suction unit (thus being disconnected from the electric mains) and does not imperatively need to be fastened with the use of tools in conformity to the rules. On the contrary, the cover 9B may not even be required, whereas the relevant recess (8) is protected on its lower side by the bottom 9A of the main body 12B.

Another important change shown in FIG. 4 refers to the preassembled motor-hub-fan unit 11B differing from the unit 11 of FIG. 2 and 11A of FIG. 3. Said unit 11B is fastened to the main body 12B of the suction unit instead of the cover 22A, with several advantages.

Since said unit 11B can be manufactured in such a way that the electric parts inside cannot be reached also when the suction unit 25 is located in its seat and operative, it is also possible to fasten the cover 22A in a usual known manner without the use of tools for its removal, with the advantage of simplifying the assembly methods and allow the user to easily provide for a complete cleaning of the air ducts.

It should be noted that said unit 11B would not be usable with the suction units manufactured according to the present state of the art, as they have no suction unit top wall surface and even by fastening said unit to the hood housing it would not be possible to pull it out without dismantling the hood itself.

According to the embodiments of the present invention described above, in contrast with most available hood types the front panel 20A shown in FIG. 5 has to be inclined backwards, at least in the area where the recess 26A to house the electric componentry 7A with outside controls is located. Thanks to this arrangement it is possible to preassemble the electric componentry 7A, already complete, on the suction unit 25 shown in FIG. 5 without any further operations from the outside of the front panel being required.

However, said particular shape of the front panel 20A is only provided as a specific aesthetic solution for a favourable use of the present invention according to the embodiments of FIGS. 3 and 4, though it does not indicate a limit for the general application of the present invention. As, a matter of fact, FIG. 6 shows how it is possible to obtain a suction unit 25A, complete according to the present invention, which can be installed in a housing 13B of a hood with a vertical front panel 20B.

With reference to FIG. 6, the suction unit 25A is obtained according to one of the several embodiments described above. Its positioning in the housing 13B is obtained by matching the centering and support wedge 23B with the centering area 24B. In its rotary and traverse motion forward, the electric componentry 7A complete with the controls accessible by the user protudes in the recess 26A while—with reference to FIG. 9—the body 28 of the first element of the electric connection means fastened to the rear side of suction unit 25A and the body 31 of the second element of said electric connection means fastened to the hood housing 13B engage each other.

It should be noticed how the embodiment of the present invention shown in FIG. 6 allows the opportunity of many aesthetic solutions, since it is quite evident—even if not shown in the figure—that the front panels can be both vertical and inclined either forward or backward without prejudice to any of the advantages of the invention herein.

It should be noticed that in many a practical applications the centering means shown in FIGS. 8A and 8B or other equivalent means may not be necessary, since with reference to FIG. 7A the lead-in features 34 and 35 on the body 31 may be enough to easily guide the pins 29 into their seat. It is obvious that other applications are also possible where said lead-in feature 34 or said lead-in feature 35 may be superfluous, however without departing from the novelty spirit of the innovative solution.

The above said, the advantages of a hood inclusive of a suction unit designed and assembled according to the present invention are quite obvious. Specifically:

- assembly of the suction unit 25 and its fastening to the hood housing 13A are now much faster as the number of fastening elements has been reduced;
- a fast dismantling of the suction unit 25 is now possible both for the maintenance technicians to carry out repair works in a comfortable position and the user for usual cleaning purposes. Said operations can be executed in a fully safe manner as by disjoining the suction unit 25 the electric connections will also be disconnected, whereas—when the unit is connected—the covers tightened by screws or removable walls surfaces protect against a casual contact. It is anyway possible, if wanted, to hinder the user from dismantling the suction unit, eg. simply replacing the wing-nuts 45 of FIG. 10 with nuts;

design of the suction unit 25 is subject to less constraints with undoubtful production cost benefits as it is no longer necessary to warrant the access to most elements requiring a likely repair from the bottom;

a motor-hub-fan assembly 11B can be installed on top of the suction unit 25;

separation of the main hood components (the housing usually made of steel-sheet, the suction unit generally made of plastic material and the electric parts) in view of a material selection for a relevant scrapping is now considerably simplified, since separation of the housing from the suction unit is easier and the electric componentry enclosed,in the unit is generally easier to reach;

the suction unit can be used more flexibly in different hood or chimney configurations, at least in all types exclusively fitted with an air outlet on the top. As a matter of fact, since complete air duct wall surfaces are possible in the suction unit 25 according to the present invention, said suction unit 25 does not necessarily need to be assembled close by a housing with a flat upper surface.

It is obvious that many amendments and changes are possible to the present invention concept without departing from the novelty spirit thereof and it is also clear that all the components and materials may differ from the ones described and be replaced with technical equivalent elements as the examples previously described are just some of the many applications possible in practical actuation.

I claim:

1. A hood comprising a housing and a suction and/or filtration unit, said suction and/or filtration unit being detachably mounted within said housing and including one or more electrical components, said housing comprising first alignment means and a first electrical connector fixedly mounted relative to said first alignment means, and means for connecting said first electrical connector to a source of electrical power, said suction and/or filtration unit comprising second alignment means and a second electrical connector fixedly mounted relative to said second alignment means, said one or more electrical components being electrically connected to said second electrical connector said first alignment means and said second alignment means cooperating for correctly positioning said suction and/or filtration unit with respect to said housing and for positioning said first electrical connector into engagement with said second electrical connector so that said first electrical connector and second electrical connector are mutually connected by mounting said suction and/or filtration unit in said housing and disconnected by dismounting said suction and/or filtration unit from said housing whereby said electrical components are electrically connected to said power source only when said suction and/or filtration unit is mounted within said housing.

2. A hood, according to claim 1, wherein said one or more electrical components comprise an electric fan motor.

3. A hood, according to claim 1 wherein said one or more electrical components comprise an electric lamp-holder.

4. A hood, according to claim 1, wherein said one or more electrical components comprise electrical control means for operating other ones of said electrical components.

5. A hood, according to claim 4, wherein said suction and/or filtration unit has a front wall from which said electrical control means projects, and said housing has a front wall with an opening, said electrical control means protruding through said opening when said suction and/or filtration unit is mounted within said housing.

6. A hood, according to claim 1 wherein said housing further comprises first alignment means and said suction and/or filtration unit further comprises second alignment means for cooperating with said first alignment means for aligning said first connecting means with said second connector for facilitating the connection of said first electrical connector to said second electrical connector.

7. A hood, according to claim 1, wherein one of said first and second electrical connector comprises a male connector and the other of said first and second electrical connector comprises a female connector.

8. A hood, according to claim 7 wherein said male connector comprises a plurality of pins each of which has a rectangular cross section and said female connector comprises a plurality of electric contacts each of which has a flat surface.

9. A hood, according to claim 7 wherein said female connector is flared for facilitating coupling with said male connector.

10. A hood, according to claim 1 wherein said suction and/or filtration unit comprises air guiding ducts.

11. A hood, according to claim 1 wherein said suction and/or filtration unit comprises a removable cover.

12. A hood, according to claim 1 wherein said housing comprises mounting means for mounting said housing on a cabinet, and said suction and/or filtration unit is mountable on said housing.

* * * * *

UNITED STATES PATENT AND TRADEMARK OFFICE

CERTIFICATE OF CORRECTION

PATENT NO : 5,775,319

DATED : July 7, 1998

INVENTOR(S) : Pettinari

It is certified that error appears in the above-identified patent and that said Letters Patent is hereby corrected as shown below:

On the title page, eighth line, after "[22] Filed: Jan. 11, 1996" insert

--[30] Foreign Application Priority Data
Jan. 12, 1995 [IT] Italy. . . . . T095A0012--.

Signed and Sealed this

Third Day of November, 1998

*Attest:*

*Attesting Officer*

BRUCE LEHMAN

*Commissioner of Patents and Trademarks*